US006332808B1

(12) United States Patent
Kanda et al.

(10) Patent No.: US 6,332,808 B1
(45) Date of Patent: Dec. 25, 2001

(54) CONNECTOR STRUCTURE

(75) Inventors: Takayoshi Kanda; Nobuyoshi Matsuda, both of Fukui (JP)

(73) Assignee: Mitsubishi Cable Industries, Ltd., Amagasaki (JP)

( * ) Notice: Subject to any disclaimer, the term of this patent is extended or adjusted under 35 U.S.C. 154(b) by 0 days.

(21) Appl. No.: 09/664,742

(22) Filed: Sep. 19, 2000

(30) Foreign Application Priority Data

Sep. 22, 1999 (JP) ..... 11-269281
Feb. 25, 2000 (JP) ..... 12-049415

(51) Int. Cl.[7] ..... H01R 9/05
(52) U.S. Cl. ..... 439/584; 439/429
(58) Field of Search ..... 439/429, 427, 439/578, 584

(56) References Cited

U.S. PATENT DOCUMENTS 5,595,502 * 1/1997 Allison ..... 439/429
5,722,855 * 3/1998 Kanda et al. ..... 439/429

* cited by examiner

*Primary Examiner*—Renee Luebke
*Assistant Examiner*—Felix O. Figueroa
(74) *Attorney, Agent, or Firm*—Armstrong, Westerman, Hattori, McLeland & Naughton, LLP

(57) ABSTRACT

A connector structure provided with a coaxial connector having an inner contact and an outer contact respectively connected to an inner conductor and an outer conductor of a coaxial cable having the inner conductor and the outer conductor respectively insulated, in which the inner contact has a tapping screw portion screwed into an inner peripheral face of the hollow inner conductor as to do self screw cutting, and the tapping screw portion has a guiding portion, formed parallel to an axis and having an outer diameter approximately same as an inner diameter of the inner conductor, on its forth end.

1 Claim, 6 Drawing Sheets

CONNECTOR STRUCTURE

BACKGROUND OF THE INVENTION

1. Field of the Invention

This invention relates to a connector structure for connecting a coaxial cable and a coaxial connector.

2. Description of the Related Art

Conventionally, a coaxial cable, coaxially having an inner conductor and an outer conductor insulated respectively, is provided with a coaxial connector having an inner contact and an outer contact respectively connected to the inner conductor and the outer conductor on its end portion to make mechanical and electrical connection between coaxial cables or with a communication apparatus.

And, in a conventional connector structure, the inner contact of the coaxial connector has a male screw portion on an end portion connected to the inner conductor. And, an inner peripheral face of the hollow inner conductor is threaded with a screw-cutting tap when connecting work is conducted, and the male screw portion of the inner contact is screwed into the threaded hole of the inner conductor. And, the outer contact of the coaxial connector is connected to the outer conductor of the coaxial cable as to cover.

However, threading the inner conductor of the coaxial cable during the connecting work causes much labor, especially, in connecting works at difficult working sites such as a top of a mountain, a roof of a building, and a top of a steel tower, working efficiency is very decreased. And, screw-cutting taps corresponding to the diameter of the inner conductor have to be made, and this causes cost further. And, when a hole is generated on a covering member of the outer contact, waterproofness may be spoiled because sealing members are not disposed between the outer contact and the outer conductor.

It is therefore an object of the present invention to provide a connector structure with which the working efficiency is improved, cost is reduced, and waterproofness is improved further.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
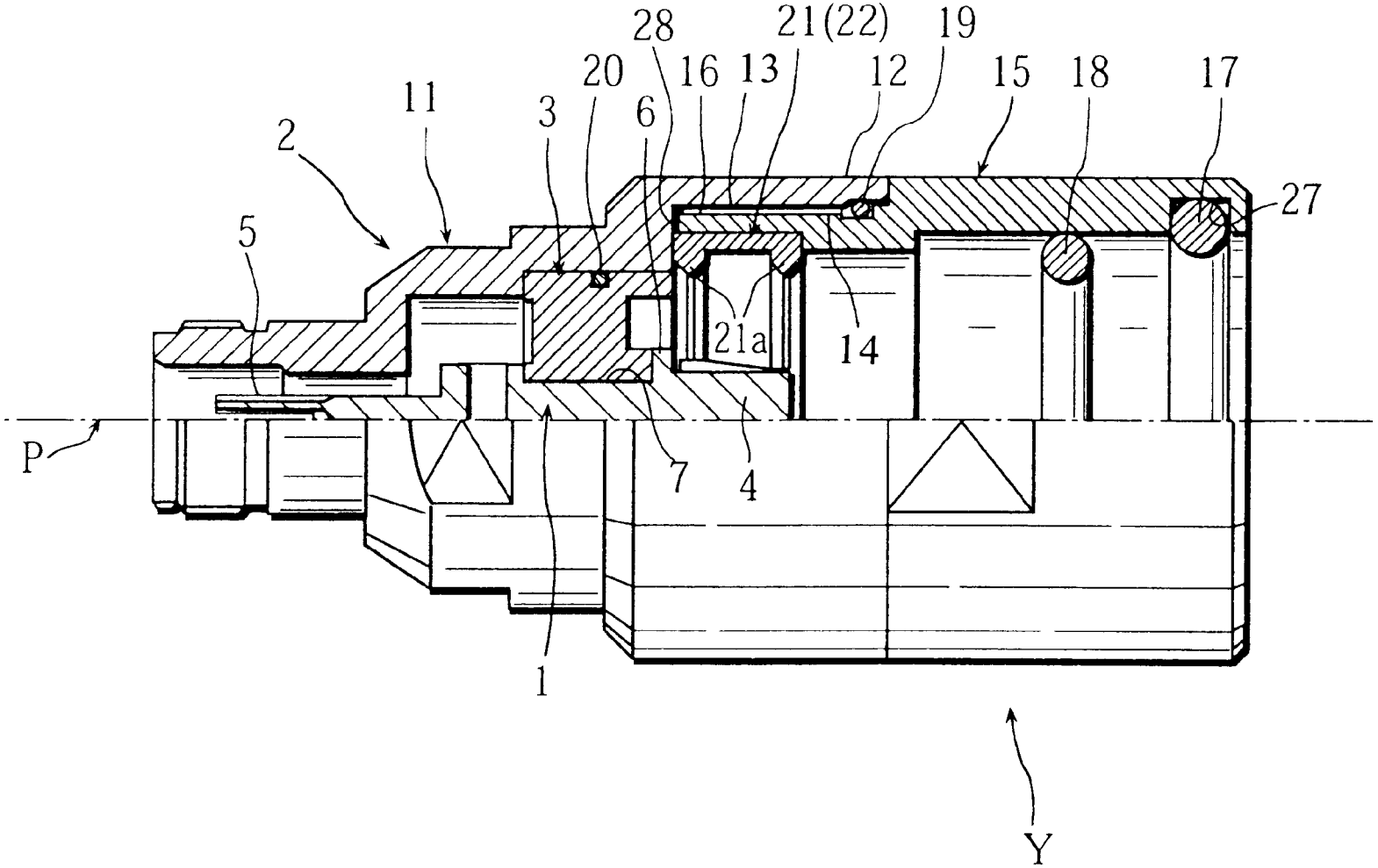
FIG. 1 is a half cross-sectional front view showing a coaxial connector of which the connector structure of the present invention is composed.
Figure 2:
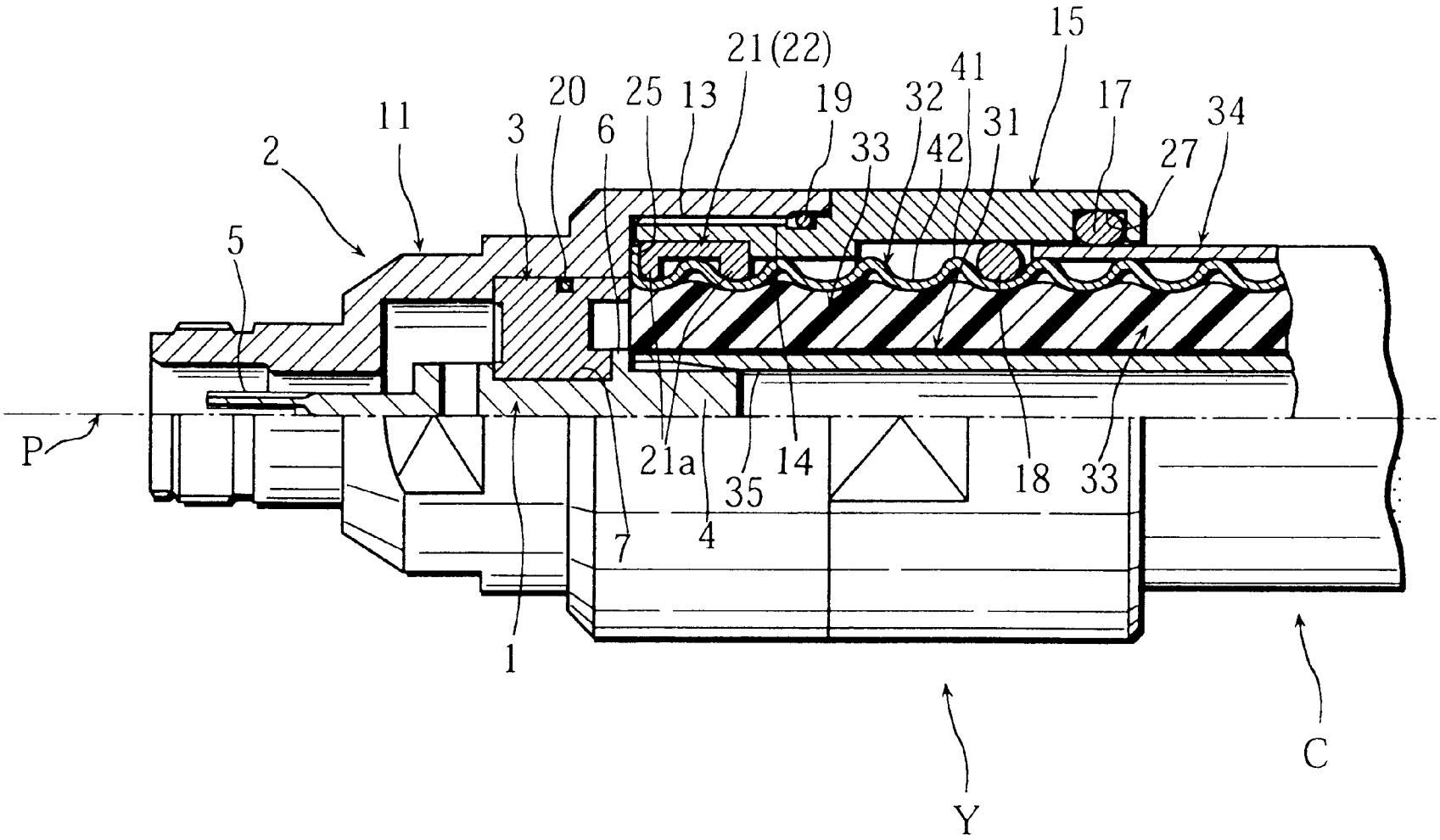
FIG. 2 is a half cross-sectional side view showing an embodiment of the connector structure of the present invention.

FIG. 1 shows a coaxial connector Y of which a connector structure of the present invention is composed. And, FIG. 2 shows an embodiment of the connector structure of the present invention (namely, a state that the coaxial connector Y is attached to an end portion of a coaxial cable C). The coaxial cable C is provided with a hollow inner conductor 31, an outer conductor 32 formed into a wavy loop (independently) having ridge portions 41 and root portions 42, an insulator 33 composed of foam material (foam plastic) disposed between the inner conductor 31 and the outer conductor 32, and a covering member 34 covering the outer conductor 32. The inner conductor 31 and the outer conductor 32 are coaxially held by the insulator 33.

The coaxial connector Y is provided with an inner contact 1, an outer contact 2 outserted to the inner contact 1, and an insulator 3 of short cylinder shape disposed between the inner contact 1 and the outer contact 2. The inner contact 1 and the outer contact 2 are coaxially held by the insulator 3.

The outer contact 2 is provided with a first connecting cylinder 11 outserted to the inner contact 1 through the insulator 3 and having a female screw portion 13 on an inner peripheral face of a large diameter portion 12 on one end side, a second connecting cylinder 15 having a male screw portion 14 which screws to the female screw portion 13 of the first connecting cylinder 11 on a peripheral face of a small diameter portion 16 on the other end side, and a split clamp 21 composed of a pair of arc half bodies 22 fitted inside the small diameter portion 16 of the second connecting cylinder 15. The split clamp 21 has a pair of arc protruding portions 21a on inner faces of the half bodies 22 with a predetermined pitch same as that of the root portion 42 of the outer conductor 32 of the coaxial cable C.

And, a concave peripheral groove 27 is formed along an opening edge on an end side of the second connecting cylinder 15, a first sealing material 17 of loop is fitted to the concave peripheral groove 27, and a second sealing material 18 is disposed on an inner portion of the outer contact 2 to the first sealing material 17 (on the small diameter 16 side on the other end of the second connecting cylinder 15). And, a third sealing material 19 is disposed between the first connecting cylinder 11 and the second connecting cylinder 15. The first, second, and third sealing materials 17 through 19 are 0-rings. And, mark 20 represents an 0-ring for holding the insulator 3.

Figure 3:
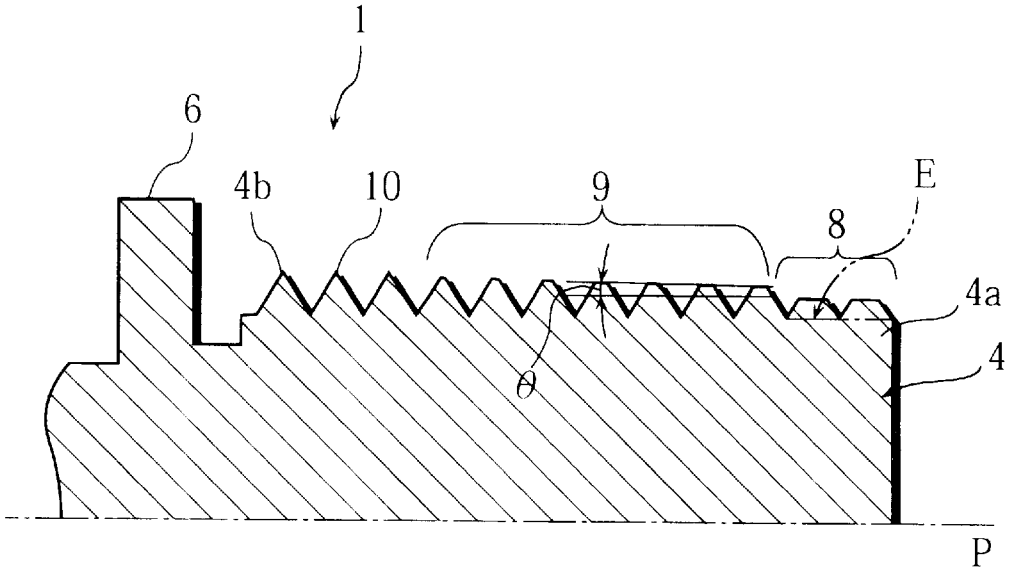
FIG. 3 is an enlarged view of a principal portion showing a tapping screw portion of an inner contact.

The inner contact 1, as shown in FIG. 1 through FIG. 3, has a tapping screw portion 4 which is screwed into an inner peripheral face 35 of the inner conductor 31 with self screw-cutting (by self tapping) on a connecting end with the inner conductor 31 of the coaxial cable C, and a connecting terminal 5 on which plural slits are formed on the other end. And, a contact portion 6 of flange which contacts an end face 24 (refer to FIG. 6) of the inner conductor 31 is formed on the other end side of the tapping screw portion 4, and a concave peripheral groove 7 fitting to an inner peripheral edge of the insulator 3 is formed on the other end side of the contact portion 6. With the contact portion 6, a contact face as a passage for electricity is certainly formed.

As shown in FIG. 1 through FIG. 4, the above-mentioned tapping screw portion 4 is, for example, composed of phosphor bronze hard and excellent in anti-abrasiveness, and a forth end 4*a* of the tapping screw portion 4 has a guiding portion 8 parallel to an axis P and formed into an outer diameter approximately same as the inner diameter of the inner conductor 31 of the coaxial cable C. Further, a chamfer portion 9 is formed on a base end 4*b* side following the guiding portion 8 of the tapping screw portion 4 by cutting threads 10 with a predetermined angle θ (2°, for example). The thread 10 on the base end 4*b* of the tapping screw portion 4 is left without cutting. That is to say, the chamfer portion 9 is formed leaving the threads 10 of the base end 4*b* on a parallel screw, then, the guiding portion 8 is formed by cutting the chamfer portion 9 on the forth end 4*a* parallel to the axis P.

Therefore, as described below, in attachment work of the coaxial connector Y to the coaxial cable C, a process of threading the inner peripheral face 35 of the inner conductor 31 of the coaxial cable C with a screw-cutting tap is omitted, workability is improved with shortened time for attachment work, and the cost is reduced because the screw-cutting tap (working) is not necessary.

Next, an example of attachment work of the coaxial connector Y constructed as described above to the coaxial cable C is described with reference to FIG. 1 through FIG. 6. First, the coaxial cable C is cut at a predetermined position (between the ridge portion 41 and the root portion 42 of the outer conductor 32), and the outer conductor 32 is exposed with cutting the covering member 34 for a predetermined length from the cut face of the cable C. On the other hand, the coaxial connector Y is disassembled into the inner contact 1 united with the insulator 3 and the outer contact 2, and the outer contact 2 is disassembled into the first connecting cylinder 11, the second connecting cylinder 15 having the first sealing material 17 and the third sealing material 19, and the split clamp 21 (the half bodies 22).

Figure 4:
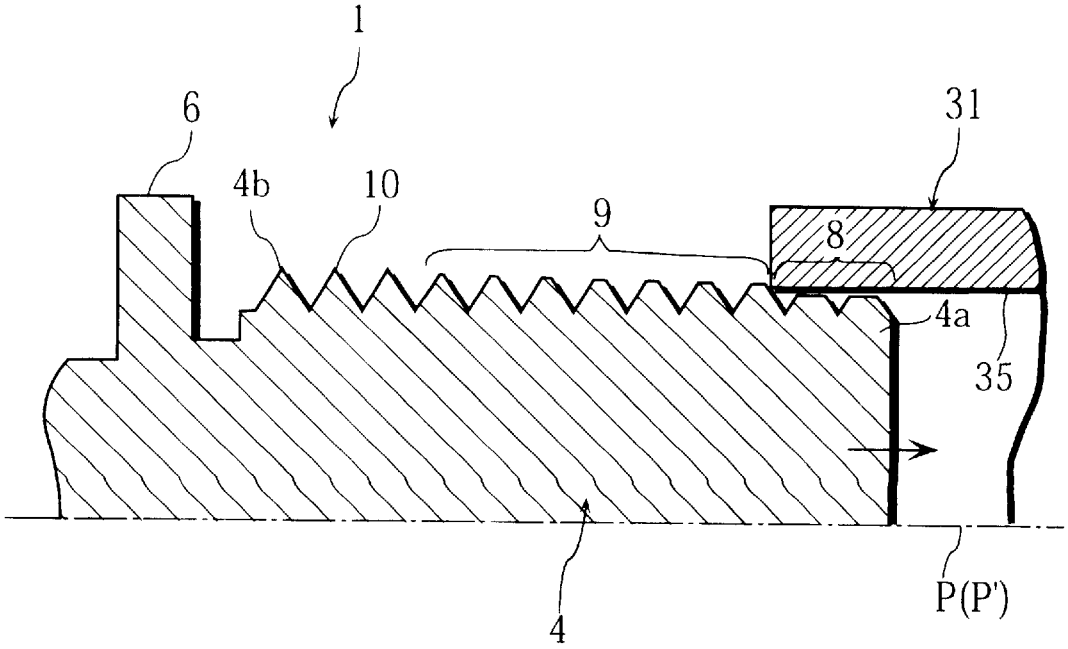
FIG. 4 an enlarged cross-sectional view of a principal portion showing a state in which a guiding portion of the tapping screw portion is inserted to an inner conductor.

Then, as shown in FIG. 4, the forth end 4*a* of the tapping screw portion 4 of the inner contact 1 is inserted to the inner conductor 31 on the end portion of the coaxial cable C. In the insertion, the tapping screw portion 4 is positioned on the same axis with an axis P' of the inner conductor 31 because the guiding portion 8 of the tapping screw portion 4 tightly fits (not inclined) to the inner peripheral face 35 of the inner conductor 31.

Figure 5:
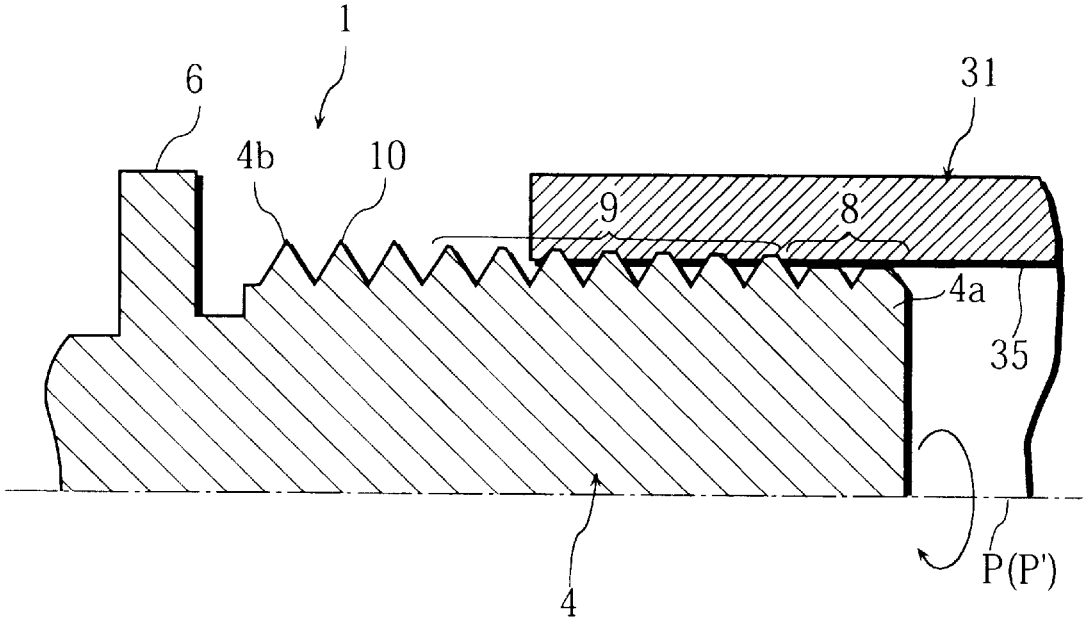
FIG. 5 is an enlarged cross-sectional view of a principal portion showing a state in which a chamfer portion of the tapping screw portion is screwed into the inner conductor.
Figure 6:
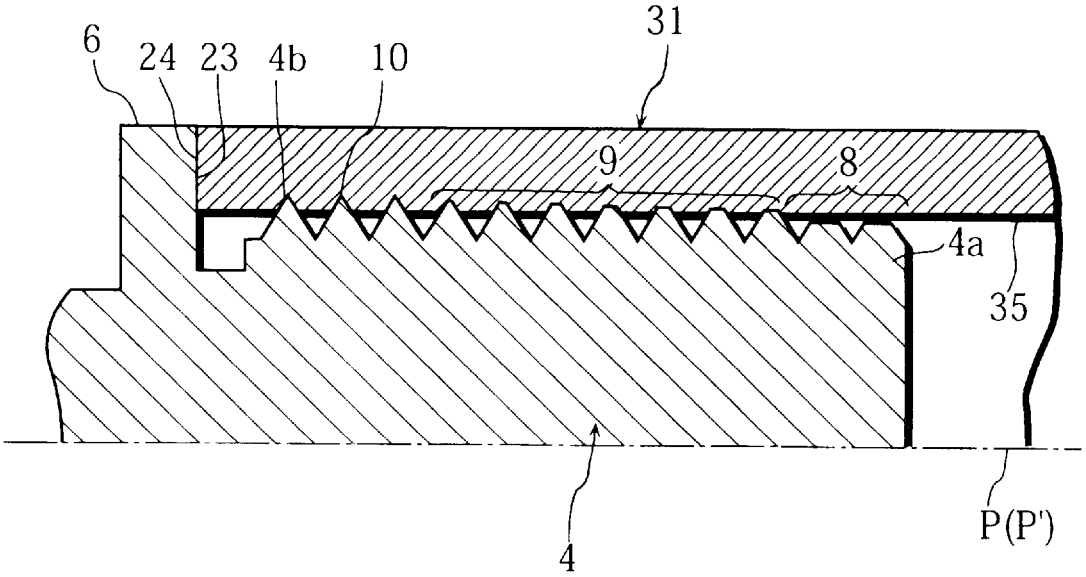
FIG. 6 is an enlarged cross-sectional view of a principal portion showing a completed state of the screwing of the tapping screw portion.

And, as shown in FIG. 5, the chamfer portion 9 of the tapping screw portion 4 is screwed into the inner peripheral face 35 of the inner conductor 31 with self screw cutting. In this case, screw torque (screw resistance) is reduced and the tapping screw portion 4, corresponding to the axis P' of the inner conductor 31, can be screwed straight smoothly with small force. And, as shown in FIG. 2 and FIG. 6, the screwing is completed when the tapping screw portion 4 is screwed completely to the thread 10 on the base end 4*b* and the end face 23 of the contact portion 6 of the inner contact 1 contacts the end face 24 of the inner conductor 31. That is to say, attachment of the inner contact 1 to the inner conductor 31 is completed.

Next, as shown in FIG. 2, the second sealing material 18 is fitted to the root portion 42 on the peripheral face of the exposed outer conductor 32, the end portion of the cut coaxial cable C is inserted to the second connecting cylinder 15 of the outer contact 2, and the second connecting cylinder 15 is temporarily moved to the covering member 34 side. Then, each of the half bodies 22 of the split clamp 21 is fitted to the outer conductor 32 as the arc protruding portions 21*a* contact the root portion 42 on the end portion of the outer conductor 32, and the second connecting cylinder 15 is moved to the end portion side of the coaxial cable C to hold the split clamp 21.

Then, the first connecting cylinder 11 comes close to the split clamp 21 side as the female screw portion 13 of the first connecting cylinder 11 is screwed to the male screw portion 14 of the second connecting cylinder 15, and the end faces of the split clamp 21 and the outer conductor 32 contact the staged portion 25 of the first connecting cylinder 11. Attachment of the outer contact 2 to the outer conductor 32 is completed thereby (attachment of the coaxial connector Y to the coaxial cable C is completed).

Figure 7:
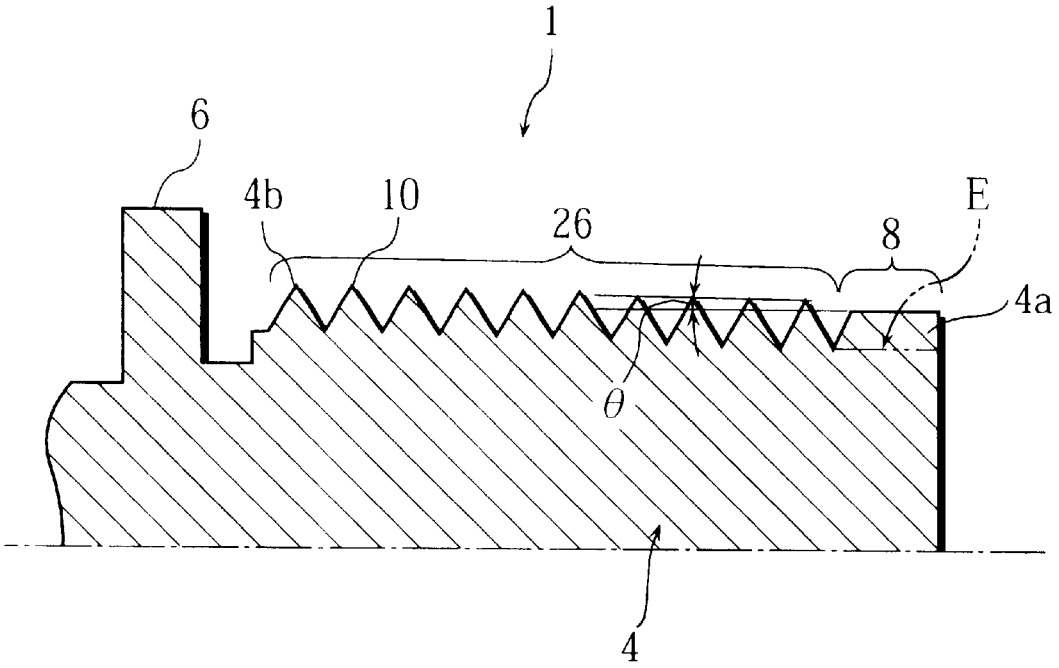
FIG. 7 is an enlarged cross-sectional view of a principal portion showing another coaxial connector.

And, in the tapping screw portion 4 of the inner contact 1 in the coaxial connector Y, the base end 4*b* side to the guiding portion 8 may be a tapered screw portion 26 as shown in FIG. 7. Taper angle θ of the tapered screw portion 26 is same as the angle (2° for example) of the chamfer portion 9 (described with FIG. 3). And, as shown in FIG. 3 and FIG. 7, it is also preferable to set the outer diameter of the guiding portion 8 same as or smaller than the diameter of the root portion of the chamfer portion 9 as shown with an imaginary line E.

Figure 8:
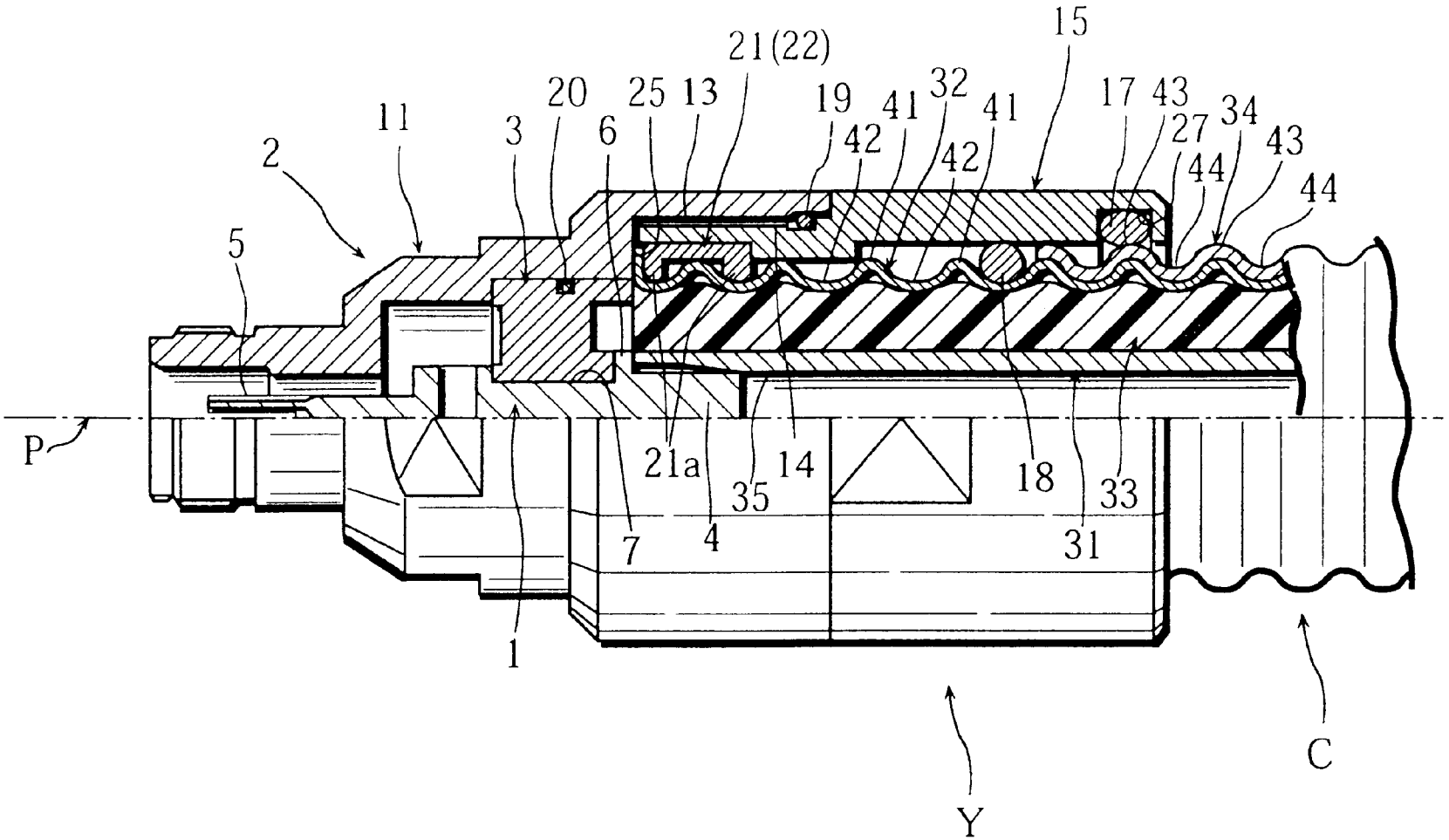
FIG. 8 is a half cross-sectional side view showing another embodiment of the connector structure of the present invention.

Next, FIG. 8 shows another embodiment of the present invention. In comparison with FIG. 2, following construction is different. That is to say, the first sealing material 17 is disposed on the position of the ridge portion 43 of the covering member 34.

To describe concretely, the covering member 34 tightly covers the outer conductor 32 and formed into a wavy loop (independently) having ridge portions 43 and root portions 44 corresponding to the ridge portions 41 and the root portions 42. And, when the coaxial connector Y is attached to the coaxial cable C, the first sealing material 17 fitted inside the outer contact 2 is disposed on the position of the ridge portion 43 of the covering member 34 covered on the outer conductor 32.

Therefore, the first sealing material 17 is sufficiently press-fitted to the outer contact 2 and the covering member 34, the coaxial connector Y and the coaxial cable C are certainly sealed, and waterproofness is improved. And, the second sealing material 18 is press-fitted to the root portion 42 of the outer conductor 32 where the covering member is removed to prevent water from getting into the coaxial connector Y in case that a hole is generated on the covering member 34.

The concave peripheral groove 27 is disposed on a predetermined part of the second connecting cylinder 15 (for example, as shown in FIG. 1, a position part from the end face 28 of the small diameter portion 16 for a predetermined distance), and set as the first sealing material 17 fitted to the concave peripheral groove 27 is press-fitted to the ridge portion 43 of the covering member 34 when the coaxial cable C cut at the predetermined position is connected to the coaxial connector Y as described above. This is for improvement of waterproofness by positioning the first sealing material 17 on the ridge portion 43 of the covering member 34 rather than the root portion 44 of the covering member 34.

And, the predetermined position of the first sealing material 17 is set corresponding to kinds of the coaxial cable C. That is to say, the predetermined position of the first sealing material 17 is determined by pitch dimensions of the ridge portion 43 (41) and the root portion 44 (42) of the covering member 34 (the outer conductor 32).

According to the connector structure of the present invention, in attachment work of the coaxial connector Y to the coaxial cable C, a process of threading on the inner peripheral face 35 of the inner conductor 31 of the coaxial cable C with a screw-cutting tap is omitted, workability is improved for shortened working time, and the cost is reduced because the screw-cutting tap is not necessary. And, the tapping screw portion 4 can be positioned coaxially with the inner conductor 31 by the guiding portion 8 of the tapping screw portion 4 of the inner contact 1, and the tapping screw portion 4 can be screwed straight into the inner conductor 31 smoothly.

And, the screw torque (screw resistance) in screwing the tapping screw portion 4 of the inner contact 1 into the inner conductor 31 of the coaxial cable C with self screw cutting is reduced, and the screwing is conducted smoothly by small force.

And, in the coaxial connector Y attached to the coaxial cable C, the contact face as a passage for electricity is certainly formed because the contact portion 6 of the inner contact 1 contacts the inner conductor 31 of the coaxial cable C.

And, the first sealing material 17 fits sufficiently tight to the outer contact 2 and the covering member 34 and sealability between the coaxial cable C and the coaxial connector Y is enhanced for excellent waterproofness because the first sealing material 17 is disposed on the position of the ridge portion 43 of the covering member 34. And, conventionally used waterproof tape is not necessary, labor is saved and workability is improved thereby.

Further, water is prevented from getting into the coaxial connector Y in case that a hole is generated on the covering member 34 because the second sealing material 18 is disposed inner to the first sealing material 17, and this improves the waterproofness further.

While preferred embodiments of the present invention have been described in this specification, it is to be understood that the invention is illustrative and not restrictive, because various changes are possible within the spirit and indispensable features.

What is claimed is:

1. A connector structure provided with a coaxial cable coaxially having an inner conductor and an outer conductor respectively insulated, and a coaxial connector having an inner contact and an outer contact respectively connected to the inner conductor and the outer conductor, wherein the outer conductor is formed into a wavy loop covered with a covering member and having ridge portions and root portions, the outer contact has a first loop of sealing material fitted inside the outer contact, the first sealing material is press-fitted to the covering member, and the outer contact is connected to the outer conductor so as to cover the outer conductor, comprising a construction in which the center of the first sealing material is disposed on a position of a peak of a ridge portion of the covering member, a second sealing material is disposed radially inner to the first sealing material in the outer contact, and the second sealing material is press-fitted to the root portion of the outer conductor where the covering member is removed.

* * * * *